US006448895B1

(12) United States Patent
Ekkel

(10) Patent No.: US 6,448,895 B1
(45) Date of Patent: Sep. 10, 2002

(54) KIDNAP ALARM WITH ACCELERATION SENSOR

(75) Inventor: Frederik Ekkel, Cupertino, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/796,584

(22) Filed: Feb. 28, 2001

(51) Int. Cl.[7] ..... G08B 23/00

(52) U.S. Cl. ..... 340/573.1; 340/573.4; 340/573.7

(58) Field of Search ..... 340/573.1, 573.4, 340/573.7, 575, 576, 425.5, 426, 439, 571, 384.71, 566, 568.1, 686.6

(56) References Cited

U.S. PATENT DOCUMENTS 4,418,337 A * 11/1983 Bader ..... 340/571
5,223,815 A * 6/1993 Rosenthal et al. ..... 340/539
5,317,304 A * 5/1994 Choi ..... 340/571
5,485,163 A 1/1996 Singer et al.
5,485,402 A * 1/1996 Smith et al. ..... 340/870.01
5,629,678 A 5/1997 Gargano
5,691,693 A * 11/1997 Kithil ..... 340/439
5,745,037 A * 4/1998 Guthrie et al. ..... 340/573.1
5,939,988 A 8/1999 Neyhart
5,990,795 A * 11/1999 Miller ..... 340/576
6,265,974 B1 * 7/2001 D'Angelo et al. ..... 340/568.1

FOREIGN PATENT DOCUMENTS

GB 2284726 A 6/1995

OTHER PUBLICATIONS http://mems.isi.edu/ "Welcome to the MEMS Clearinghouse".
http://www.analog.com/imems, "Technologies/applications IMEMS©", by Analog Device, Inc.
http://www.analog.com/imems/markets/automotive/car_alarms.html.

* cited by examiner

*Primary Examiner*—Van Trieu
(74) *Attorney, Agent, or Firm*—Gwen Le Pennec

(57) ABSTRACT

A personal security device includes a motion sensor, such as a MEMS chip. In response to a characteristic motion pattern, especially acceleration of a car, the security device will trigger a consequence. The consequence might be an audible or visible alarm. Optionally the device may communicate with the engine to direct it to take some action, such as stopping or exploding air bags.

14 Claims, 3 Drawing Sheets

FIG. 1A
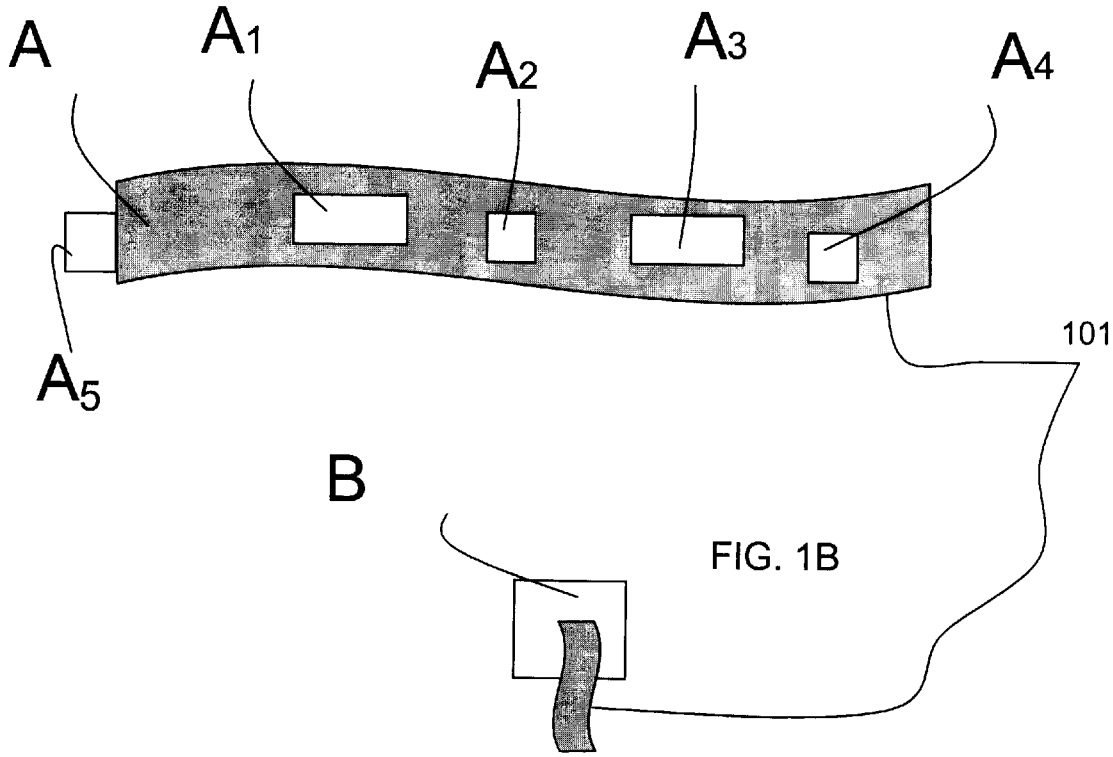
FIG. 1B
FIG. 1C
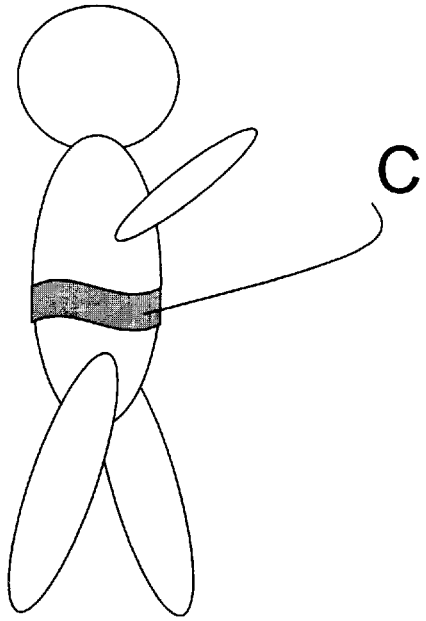

KIDNAP ALARM WITH ACCELERATION SENSOR

BACKGROUND OF THE INVENTION

A. Field of the Invention

The invention relates to the field of anti-kidnapping alarms for children.

B. Related Art

U.S. Pat. No. 5,939,988 shows an alarm device for monitoring the proximity of a child and for putting out an alarm if the child exceeds a given distance. This device has the disadvantage of insufficient flexibility. What if the child needs to go to school or to visit grandparents?

Other such devices, e.g. GB 2,284,726, depend on the child to activate the device, which may not be wise in the presence of a dangerous kidnapper.

SUMMARY OF THE INVENTION

It is an object of the invention to further improve anti-kidnapping alarm devices.

This object is achieved by a device that includes a sensor that can determine a characteristic motion pattern and produce a consequence in response to such a pattern. The characteristic motion pattern will most typically be that of acceleration of a motor vehicle. Since most kidnapped children will be placed in automobiles, this will allow instant detection of most kidnapping.

Further objects and advantages will become apparent in the following.

BRIEF DESCRIPTION OF THE DRAWING

The invention will now be described by way of non-limiting example with reference to following drawings.

FIG. 1*a* is a schematic diagram of a belt useful in carrying the invention.

FIG. 1*b* is a schematic diagram of a wall mounted battery loader.

FIG. 1*c* is a schematic diagram of a child wearing the belt of FIG. 1*a*.

DETAILED DESCRIPTION OF THE PREFERRED EMBODIMENTS

The alarm according to the invention should be packaged so as to be attractive to children, to motivate them to wear the device, such as with cartoon characters, bright colors, or a camouflage motif. The bright coloring also serves to notify potential kidnappers that this child is protected, which makes them more likely to turn to another child as a victim. The preferred embodiment of the invention is part of a decorative belt that a child could wear as a kind of toy or costume. However, those of ordinary skill in the art of child apparel and toys might devise any number of other carrying apparatus for the invention that would be appealing to children.

Figure 3:
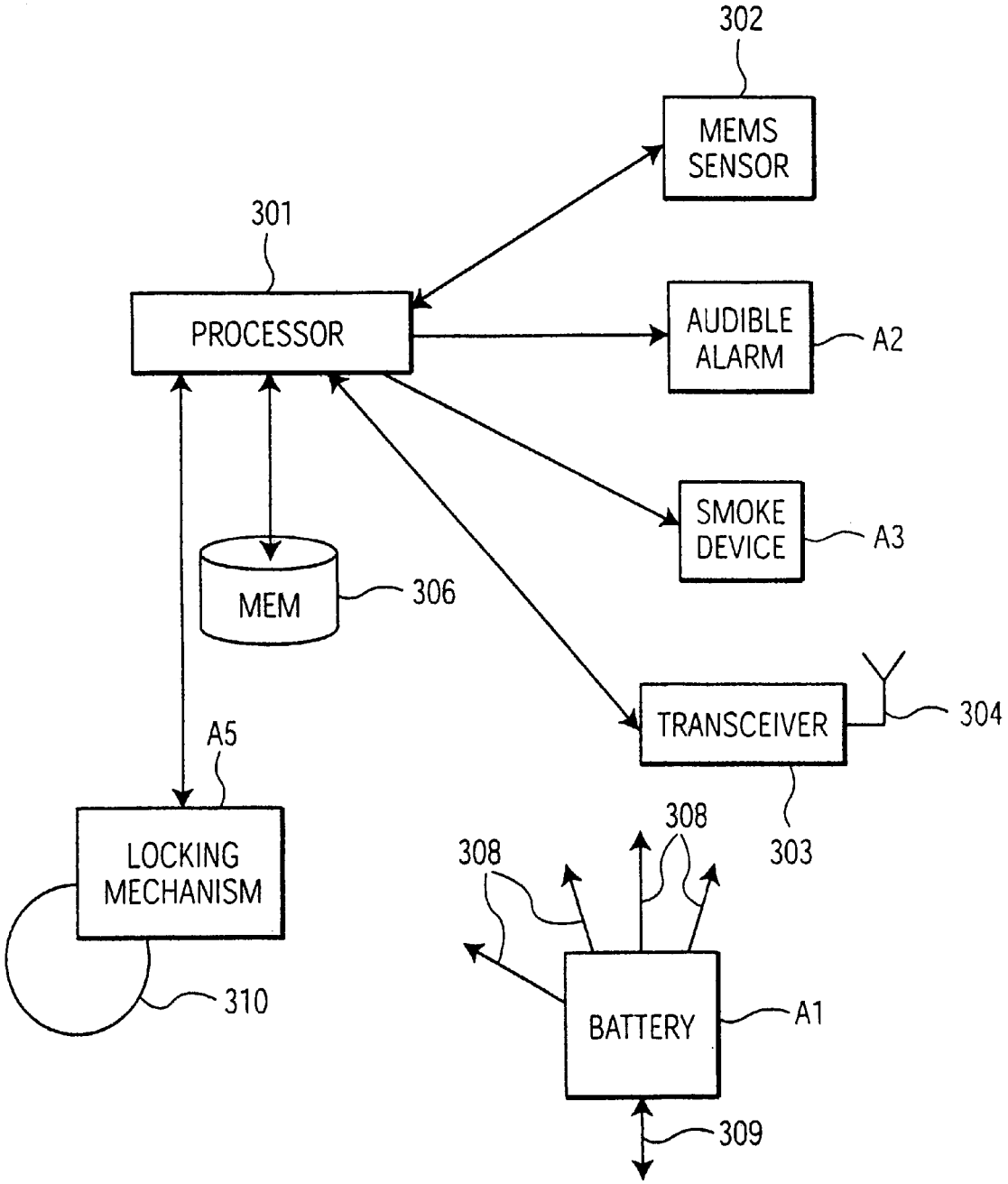
FIG. 3 is a high level circuit diagram for a belt in accordance with the invention.

FIG. 1*a* is a schematic of the preferred belt A, while FIG. 3 shows a schematic circuit diagram. The belt carries a MEMS movement sensor 302, such as the IMEMS® chip marketed by Analog Devices, Inc., together with a processor 301 and a battery at A1. The belt also carries a siren A2, a visible alarm A3, accessories of interest to the child at A4, and a locking mechanism A5. Preferably the visible alarm A3 is smoke alarm adapted to release smoke of a distinctive color, such as orange, to increase the attention brought to bear on the situation. Such smoke detectors are currently used in pilot lifejackets. The accessories A4 might include a radio, an MP3 player, a toy, or any other items of interest to the child.

FIG. 1*b* is a schematic of a wall mounted battery charger. The belt 101 preferably contains a rechargeable battery A1 and so at the end of the day, when the child is home eating diner and going to bed, the belt is placed in recharging device C hanging on the wall. Preferably the device is placed in a prime location somewhere in such as the kitchen. This way the child's parent or guardian can instantly check if the child is wearing it or not. The entire belt 101, with its bright colors, is preferably inserted into the device C, rather than just the battery, so that the need to put the belt back on the child is more apparent. For the purpose of recharging, the battery A1 must have a connection 309 external to the belt as well as connections 308 to all the devices on the belt needing power.

Alternatively, the belt may be used with a conventional battery, but still hung in the charger, to be more obvious.

FIG. 1*c* is a schematic of the appearance of the preferred belt when a child is wearing it.

Figure 2:
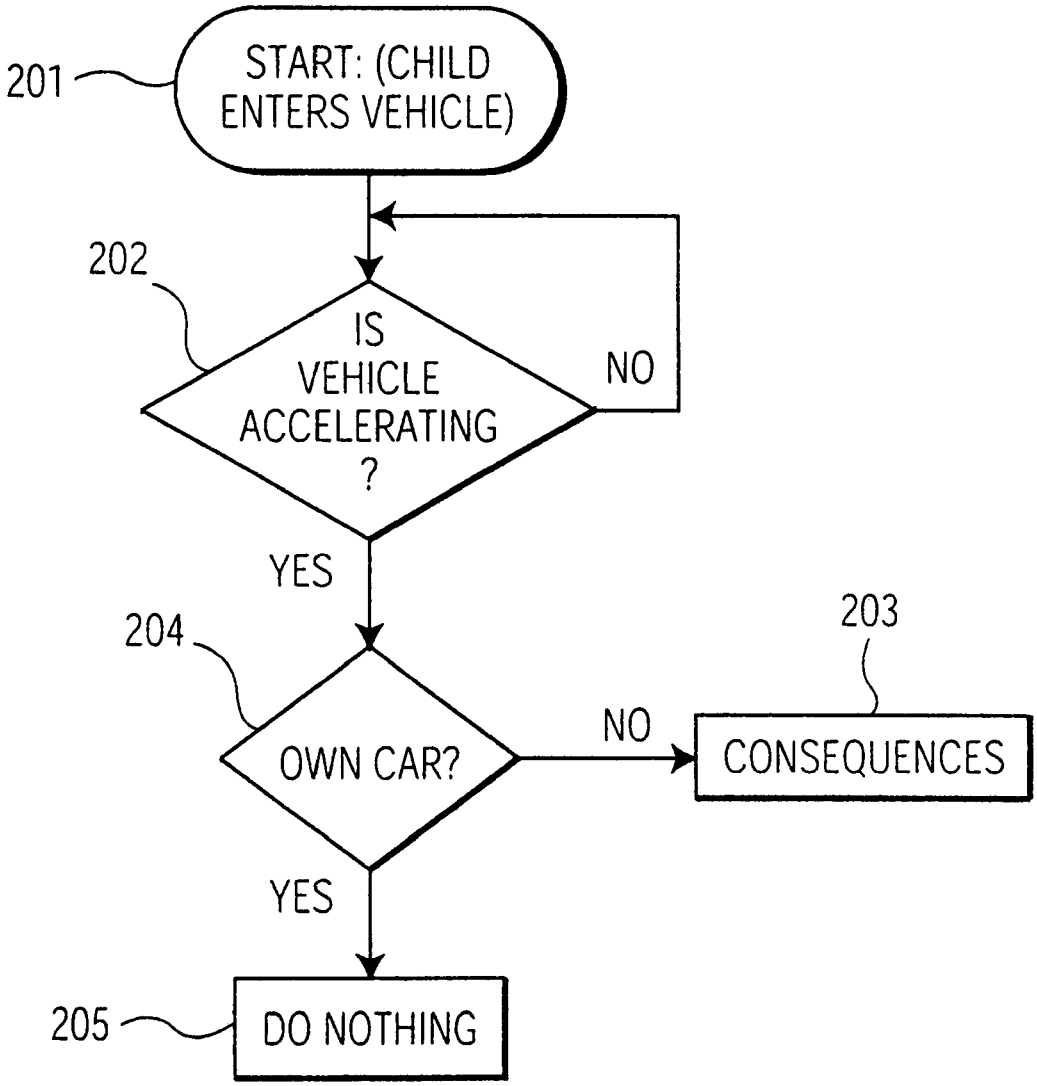
FIG. 2 is a flowchart showing operation of the invention.

The belt has a locking mechanism A5, that can only be opened by a key. The key may be physical; or the locking mechanism may be responsive to numerical keys, a spoken password, or any other suitable security device. Preferably, the child does not have the key in his possession, so the kidnapper cannot remove the belt or ask the child to remove it. Preferably the locking mechanism includes a circuit 310 that goes all along the belt, so that, if the belt is broken at any point, or if the lock is opened by force, the alarm will go off FIG. 2 shows a flowchart of the operation of the processor 301 with respect to triggering the alarm in response to motion detection. The processor 301 may execute other operations, such as detecting breakage of the belt via the locking mechanism A5, but these other operations are not shown here.

At 201, the child with the belt enters a motor vehicle. Optionally, entry into the vehicle may be confirmed by additional circuitry such as transceiver 303, which may communicate via antenna 304 with the engine, or may detect characteristic electric or magnetic fields produced by the car. Otherwise, if entry into the vehicle cannot be detected, 201 may simply be regarded as a "start" box.

At 202 the MEMS chip 302 is queried to determine if vehicle acceleration is detected, until a positive detection is made. The MEMs sensor 302 is programmed to detect the very specific acceleration curve of a motor vehicle, such as an automobile. Such programming can be done as a result of a statistical analysis of acceleration patterns undertaken by the manufacturer of the belt.

Alternatively, a pattern or patterns of movement may be stored in memory 306. Every motion detected by the MEMS chip 302 can then be compared in accordance with a chosen comparison procedure with contents of memory 306.

Another alternative is that the belt may have artificial intelligence capability (not shown) that allows the belt to learn, during a learning period, characteristic accelerations of friendly vehicles. There might be several such vehicles, such as two family cars and a school bus. These artificial intelligence capabilities may, for instance, be resident in neural networks or genetic algorithms.

Movements other than vehicle acceleration like riding a bicycle, running, jumping from a tree, etc., are also detected by the sensor, but these will not cause control to pass on to box 204. If the device is able to distinguish friendly vehicle acceleration patterns, these also may prevent passing to box 204.

If the acceleration pattern is that of a vehicle, optionally an additional check is done at 204 to determine if the vehicle is "friendly". This may be done by a wireless link between transceiver 303 and an anti-theft system in the vehicle. The circuitry necessary to make this determination will add to the cost of the belt, so that it might be left out of the cheaper versions. In such a case, if the child's parent or guardian forgets to remove the belt, the alarm is more likely to be triggered even in a friendly vehicle. The wireless link is more advisable with less sophisticated techniques for detecting acceleration patterns, i.e. with techniques that fail to allow for learning patterns of several individual vehicles.

If the motor vehicle is "friendly" then nothing happens per 205.

If the motor vehicle is not recognized as "friendly", or if there is no friendly vehicle check, then some consequence should ensue. Those of ordinary skill in the art might devise any number of consequences such as:

activation of siren A2, ignition of a smoke alarm A3, stopping of the motor vehicle engine, remote signaling to a base station, presumably in the home or on the person of a parent or guardian via transceiver 303; and/or exploding of the motor vehicle's air bags.

Consequences such as stopping of the engine or exploding of the air bags would require communication between the transceiver 303 and the engine. Corresponding modifications to the engines of commercially sold vehicles would then be required to receive such signals. Appropriate security checks should be performed in the engines prior to accepting such signals, in order to prevent miscreants from remotely interfering with the operation of the vehicles and/or to prevent explosion of the air bags if the child is in the front seat.

Other patterns of motion might trigger some consequence as well. For instance a period of no motion after a fall might indicate that a child was injured or unconscious and might trigger an alarm.

From reading the present disclosure, other modifications will be apparent to persons skilled in the art. Such modifications may involve other features which are already known in the design, manufacture and use of personal security devices and which may be used instead of or in addition to features already described herein. Although claims have been formulated in this application to particular combinations of features, it should be understood that the scope of the disclosure of the present application also includes any novel feature or novel combination of features disclosed herein either explicitly or implicitly or any generalization thereof, whether or not it mitigates any or all of the same technical problems as does the present invention. The applicants hereby give notice that new claims may be formulated to such features during the prosecution of the present application or any further application derived therefrom.

The word "comprising", "comprise", or "comprises" as used herein should not be viewed as excluding additional elements. The singular article "a" or "an" as used herein should not be viewed as excluding a plurality of elements.

What is claimed is:

1. An anti-kidnapping device comprising:

a carrier adapted to attach to a person to be protected;

a motion detector; and a processor adapted to perform the following operations determining whether a current motion detected by the motion detector matches a known motion patter representative of an acceleration of a motor vehicle; and triggering consequence if a match is found.

2. The device of claim 1 wherein the carrier is expected to be attractive to a child.

3. The device of claim 1, wherein the known pattern is a known pattern of acceleration. motor vehicle.

4. The device of claim 1, wherein the consequences comprise triggering some kind of alarm.

5. The device of claim 4, wherein the alarm makes a sound.

6. The device of claim 4, wherein the alarm releases smoke.

7. The device of claim 1, wherein the consequences comprise communicating with a vehicle engine to direct it to take some action.

8. The device of claim 1, wherein the known motion pattern is not representative of an acceleration of a known motor vehicle.

9. A method for enhancing personal security comprising:

transporting a security device on a person whose protection is sought;

within the security deice, determining whether a current motion of the person matches a known motion pattern representative of an acceleration of a motor vehicle; and in response to detection of the motion pattern, within the security device, triggering a consequence.

10. The method of claim 9, wherein the known pattern is a known pattern of acceleration.

11. The method of claim 9, wherein the consequence comprises communicating with an engine to direct the engine to take some action.

12. A medium, readable by a processing device, embodying code for performing the following operations:

determining where a current motion of an attached person matches a known motion pattern representative of an acceleration of a motor vehicle; and in response to detection of the motion pattern, triggering a consequence.

13. The medium of claim 12, wherein the known pattern is a known pattern of acceleration.

14. The medium of claim 12, wherein the consequence comprises communicating with an engine to direct the engine to take some action.

* * * * *